United States Patent [19]

Forberg et al.

[11] 4,171,857

[45] Oct. 23, 1979

[54] CLEAT CONNECTOR FOR INSULATED WIRES

[75] Inventors: Horst Forberg; Manfred Müller, both of Berlin, Fed. Rep. of Germany

[73] Assignee: Krone GmbH, Berlin, Fed. Rep. of Germany

[21] Appl. No.: 908,937

[22] Filed: May 24, 1978

[30] Foreign Application Priority Data

Jun. 7, 1977 [DE] Fed. Rep. of Germany ..... 2725551

[51] Int. Cl.[2] ..... H01R 9/08

[52] U.S. Cl. ..... 339/97 P

[58] Field of Search ..... 339/98, 99, 97 R, 97 P

[56] References Cited

U.S. PATENT DOCUMENTS

| | | | |
|---|---|---|---|
| 3,702,456 | 11/1972 | Patton | 339/98 |
| 3,820,058 | 6/1974 | Friend | 339/99 R |
| 3,877,771 | 4/1975 | Jensen et al. | 339/99 R |
| 3,899,237 | 8/1975 | Briggs, Jr. | 339/99 R |
| 4,013,332 | 3/1977 | Dauser, Jr. | 339/98 |
| 4,066,317 | 1/1978 | Bierenfeld et al. | 339/98 |

FOREIGN PATENT DOCUMENTS

| | | | |
|---|---|---|---|
| 2280215 | 2/1976 | Fed. Rep. of Germany | 339/98 |

*Primary Examiner*—Joseph H. McGlynn

*Attorney, Agent, or Firm*—Weingarten, Maxham & Schurgin

[57] ABSTRACT

The invention relates to a structure including a cleat connector for providing an electrical connection between an insulated wire and a bifurcated terminal element of electrically conductive resilient material. The terminal element includes a pair of leaf-spring contact arms lying in a plane and defined by a centrally located slot therein having sharp edges and adjoining an enlarged entry opening. The width of the slot is less than the diameter of the metallic conductor of the wire so that when the wire is pressed into the slot, the wire insulation is cut through, and an electrical connection is established between the wire conductor and the terminal element. A clamping element is associated with the terminal element for gripping the insulated wire.

12 Claims, 6 Drawing Figures

(I-I)

CLEAT CONNECTOR FOR INSULATED WIRES

More particularly, the invention relates to an improvement of such a cleat connector, or of a modified embodiment thereof, so that a substantially larger number of such cleat connectors can be accommodated on a terminal strip in an even smaller space.

According to the present invention the cleat connector for an insulated wire comprises a carrier plate, and a flat bifurcated terminal element of electrically conductive resilient material mounted on the carrier plate. The terminal element includes a pair of leaf-spring contact arms lying in a plane and defined by a centrally located slot therein having sharp edges and adjoining an enlarged entry opening in the terminal element.

The width of the slot is less than the diameter of the metallic conductor of the wire so that when the wire is pressed into the slot, the wire insulation is cut through, and an electrical connection is established between the wire conductor and the terminal element. The connector further includes a clamping element which is associated with the terminal element and is intended for gripping the insulated wire. The improvement comprises the clamping element being constructed as an insulating member and having a slot extending centrally with respect to a rectangular cross-sectional surface area thereof and vertically downward. Further, the terminal element is fixedly disposed on the carrier plate at an angle offset by about 45° with respect to the slot in the clamping element, and the clamping element substantially encloses the terminal element in its structural configuration.

One embodiment of the present invention will be described now by way of example only with particular reference to the accompanying drawings in which.

Figure 1:
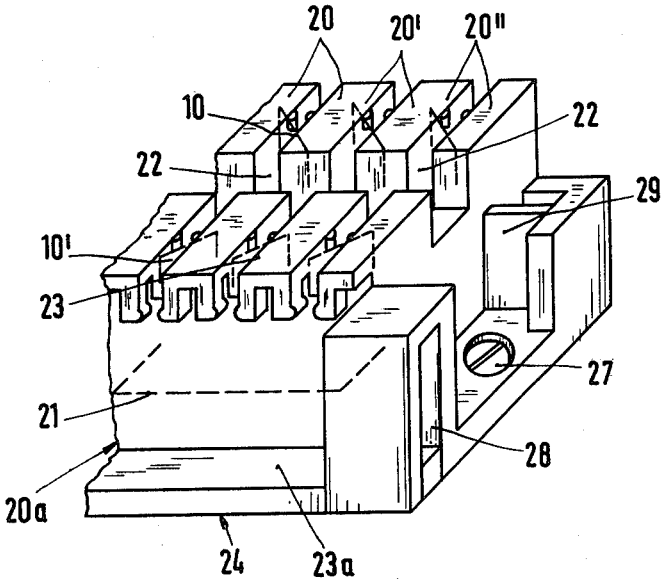
FIG. 1 is a fragmentary perspective view of a terminal strip comprising a plurality of cleat connectors according to the invention, this view showing three double terminal connector elements.
Figure 2:
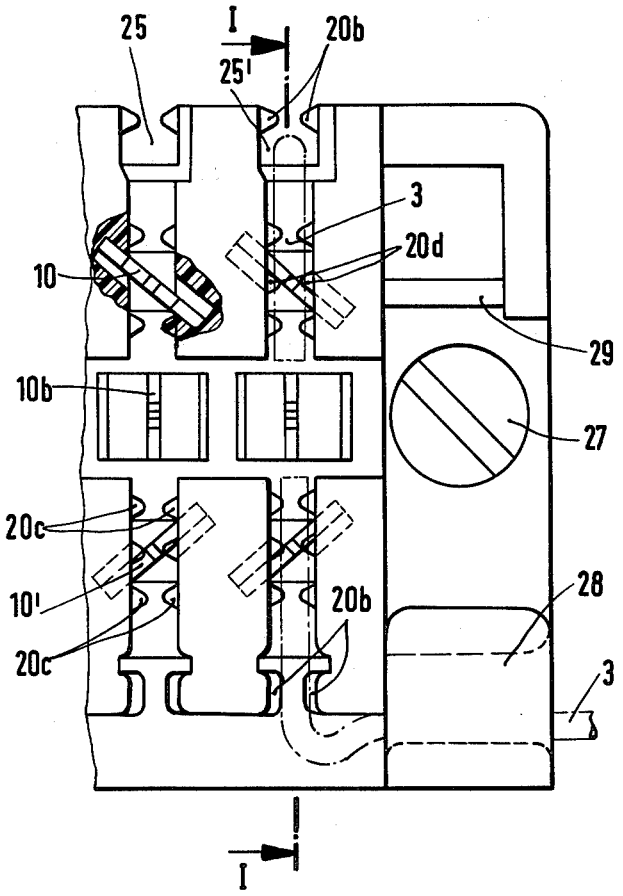
FIG. 2 is the plan view of part of the terminal strip according to FIG. 1.

In the illustrated structure, each cleat connector 23 for one or more insulated wires or cable conductors 3 comprises a flat bifurcated terminal element 10 which is constructed of a spring metal, and a clamping element 20 which is constructed of plastic as an insulating member 20*a* (FIG. 1). The clamping element 20 has a vertical slot 22 which extends centrally with respect to one edge of the insulating member 20*a*, i.e. centrally with respect to its rectangular cross-sectional surface area 21, slot 22 being provided for insertion therein of a wire 3. The terminal element 10 is arranged at an angle of 45° to the slot 22 and is substantially enclosed by the clamping element 20. The clamping element 20 is attached to a carrier plate 23*a*, thus constituting a structural unit 24 in which the terminal element 10 is also fixedly disposed (FIGS. 1 and 2).

The wire 3 is connected by being inserted manually into the slot 22. The wire then engages behind a retaining device 20*d* and is disposed in an enlarged opening

10*c* of the terminal element 10. The wire 3 is moved into its clamping and connecting position by means of a setting tool. In this operation the wire 3 is pressed into a centrally located contact slot 10*d* having a width less than the diameter of the wire conductor. As a result of the terminal element 10 being offset at an angle, the edges of the slot 10*d* penetrate through the insulation of the wire 3 and contact the wire conductor. The wire 3 is simultaneously cut off with the setting tool. It will be noted that slot 10*d* thereby defines a pair of leaf-spring contact arms on terminal element 10 which lie in the plane thereof.

To secure the connecting wire the clamping element 20 is provided with four clamping studs 20*c* which penetrate into the insulation of the wire and provide an effective cord grip.

Figure 3:
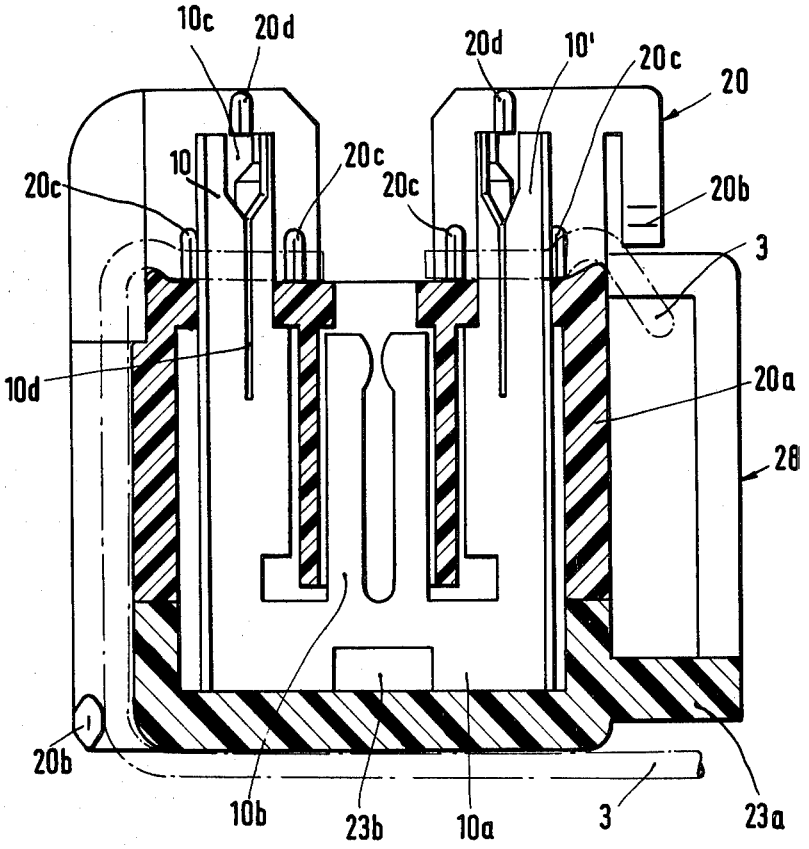
FIG. 3 is a section along the line I—I of FIG. 2.

To additionally secure the wire 3 it is guided through wire ducts 25, 25' upstream of the connecting plate and is again guided over a ratchet device 20*b* (FIGS. 2 and 3).

As indicated in FIG. 3 every two terminal elements 10 and 10' together with a transverse web 10*a* are combined into one unit. Every two or all clamping elements 20, 20', 20'' . . . are likewise connected to each other. This double terminal element 10 and 10' is retained centrally in a slotted guide strip 23*b* of the carrier plate 23*a*.

Between the two terminal elements 10 and 10' the cross web 10*a* supports a contact spring 10*b* for accommodating an arrester stack (FIG. 3).

The complete structural unit of the terminal strip 24 is obtained by joining together a plurality of cleat connectors 23 in which one half of the clamping element 20 is combined into an integral unit with the adjacent half 20' (FIG. 1).

Figure 6:
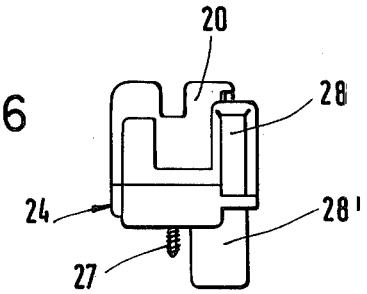
FIG. 6 is an end view of the terminal strip according to FIGS. 4 and 5.
Figure 4:
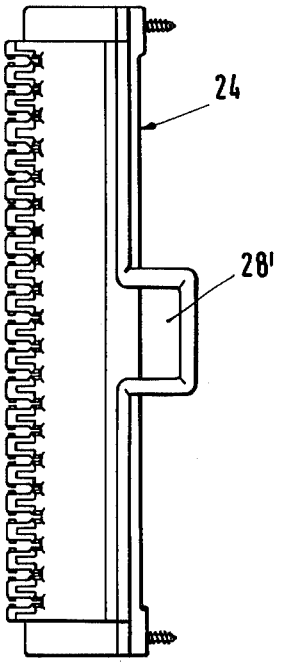
FIG. 4 is a side view of a complete terminal strip according to FIGS. 1 to 3.

To combine several wires 3, for example in the form of a cable harness, each of the two ends as well as the middle bottom of the carrier plate 23*a* of the complete terminal strip 24 is provided with a wire guide loop 28 and 28' as indicated in FIGS. 1, 4 and 6.

Figure 5:
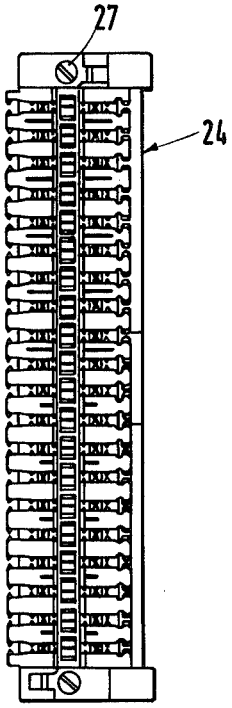
FIG. 5 is a plan view of the terminal strip according to FIG. 4.

Each of the endfaces of the terminal strip 24 is provided with a mounting screw 27 for mounting on a rack not shown (FIGS. 1 and 5).

Each of the ends of the carrier plate 23*a* supports a grounding contact 29, as indicated in FIGS. 1 and 2, for receiving an arrester stack.

As can be seen more particularly by reference to FIGS. 4 to 6 the complete terminal strip, based on the previously described details of the invention, can be manufactured in a very compact construction, thus permitting substantially improved utilisation of the available space.

What we claim is:

1. A structure including a cleat connector for providing an electrical connection with an insulated wire, said connector comprising:

a carrier plate;

a flat bifurcated terminal element of electrically conductive resilient material mounted on said carrier plate, said terminal element including a pair of leaf-spring contact arms lying in a plane defined by a centrally located slot therein having sharp edges and adjoining an enlarged entry opening in the terminal element, said slot in the terminal element having a width which is less than the diameter of the metallic conductor of the wire so that when the wire is pressed into the slot, the wire insulation is cut through and an electrical contact connection is established between the wire conductor and the terminal element; and a clamping element attached to said carrier plate and associated with the terminal element for gripping the insulated wire;

wherein the improvement comprises:

said clamping element being constructed as an insulating member and having an open slot extending centrally with respect to a rectangular cross-sectional surface area thereof and vertically downward;

said terminal element being fixedly disposed on said carrier plate at an angle offset by about 45° with respect to the slot in said clamping element; and said clamping element substantially enclosing the terminal element in its structural configuration.

2. A structure according to claim 1 wherein the insulating member of said clamping element is provided with ratchet devices, clamping studs, and retaining ribs for securing the inserted wire.

3. A structure according to claim 1 wherein a plurality of said cleat connectors are fixedly disposed adjacent to each other on said carrier plate in the form of a structural unit.

4. A structure according to claim 3 wherein one half of each clamping element together with the other half of an adjacent clamping element forms an integral unit.

5. A structure according to claim 1 wherein said cleat connector further includes a second flat bifurcated terminal element of the same construction as said first-mentioned terminal element and connected thereto by means of a transverse web, said first-mentioned and second terminals and the interconnecting transverse web comprising a unitary double terminal element.

6. A structure according to claim 5 wherein each of said flat terminal elements form an angle of about 45° with respect to the plane of said transverse web, and said interconnected terminal elements form an angle of 90° with respect to each other.

7. A structure according to claim 6 wherein said carrier plate has a slotted guide strip which extends longitudinally in the center of said carrier plate and into which the double terminal elements are inserted.

8. A structure according to claim 6 wherein a contact spring is disposed on the transverse web of said double terminal element.

9. A structure according to claim 6 wherein the structural unit is provided with at least two ducts for a plurality of incoming and/or outgoing insulated wires which are to be connected.

10. A structure according to claim 9 wherein at least one wire guide loop is formed on the carrier plate and at least one wire guide loop is formed on the insulating member.

11. A structure according to claim 6 wherein a plurality of said cleat connectors are fixedly disposed adjacent to one another or said carrier plate in the form of a structural unit, and one half of each clamping element together with the other half of an adjacent clamping element forms an integral unit.

12. A structure according to claim 11 further including a grounding contact disposed on said carrier plate.

* * * * *